US005157835A

United States Patent [19]

Lazarchik et al.

[11] Patent Number: 5,157,835

[45] Date of Patent: Oct. 27, 1992

[54] SAFETY RAZOR HANDLE ASSEMBLY

[75] Inventors: Daniel B. Lazarchik, Boston; Domenic V. Apprille, Jr., Arlington, both of Mass.

[73] Assignee: The Gillette Company, Boston, Mass.

[21] Appl. No.: 721,067

[22] Filed: Jun. 26, 1991

[51] Int. Cl.[5] ..... B26B 21/14

[52] U.S. Cl. ..... 30/85; 30/47; 30/87

[58] Field of Search ..... 30/85, 47, 87, 89, 57

[56] References Cited

U.S. PATENT DOCUMENTS

| | | | |
|---|---|---|---|
| 3,878,605 | 4/1975 | Braginetz | 30/85 |
| 4,026,016 | 5/1977 | Nissen | 30/47 |
| 4,094,063 | 6/1978 | Trotta | 30/87 |
| 4,168,571 | 9/1979 | Francis | 30/47 |
| 4,198,746 | 4/1980 | Trotta | 30/47 |
| 4,253,235 | 3/1981 | Jacobson | 30/87 |
| 4,475,286 | 10/1984 | Saito | 30/85 |
| 4,492,025 | 1/1985 | Jacobson | 30/87 |
| 5,050,301 | 9/1991 | Apprille, Jr. | 30/87 |

*Primary Examiner*—Frank T. Yost
*Assistant Examiner*—Hwei-Siu Payer
*Attorney, Agent, or Firm*—Owen J. Meegan; Aubrey C. Brine; Donal B. Tobin

[57] ABSTRACT

A razor handle assembly comprising a grip portion formed of a pair of shells mounted on opposite sides of a substantially flat planar body member. The pair of shells extend downwardly at an angle beyond one end of the planar body member and form a housing containing operative structure responsive to a pair of opposed buttons extending outwardly from the housing sides to provide attachment of a razor blade assembly onto the handle.

17 Claims, 3 Drawing Sheets

SAFETY RAZOR HANDLE ASSEMBLY

BACKGROUND OF THE INVENTION

The present invention relates to wet shaving implements and more particularly to a razor handle assembly on which a blade assembly is pivotably movable during a shaving operation.

A number of razor handles are available on the market which are designed to receive a cartridge releasably attached to the razor handle and pivotably supported about an axis parallel to the razor edge. Razors of this type are to be found in U.S. Pat. Nos. 4,026,016 issued May 31, 1977, 4,198,746 issued Apr. 26, 1980, 4,253,237 issued Mar. 3, 1981, 4,253,236 issued Mar. 3, 1981, 4,253,235, issued Mar. 3, 1981; and 4,492,025 issued Jan. 8, 1985, all assigned to the assignee of the present invention.

In U.S Pat. No. 4,168,571 issued Sep. 25, 1979 and assigned to the assignee of the present invention, it is also suggested to employ a razor of the block type comprising a casing of a size and shape to be gripped in the palm of the hand in the manner of a conventional electric razor, however, to be employed with blade members in the wet shaving process.

While many of the various razor structures employing elements of the aforementioned patents have gained popularity and various modifications have achieved commercial success, a need has arisen for a razor of the type to be held in the palm of the user's hand which is lightweight, simple in construction and is attractive to the consumer.

It is therefore an object of the present invention to provide a razor handle assembly of the type to be held with the fingers or in the palm of the hand which is simple in manufacture of its components and easy to assembly.

Another object of the invention is to provide a razor handle of the above type which combines a simple structure for attachment of blade elements to the handle combined with a substantially rigid hand-gripping portion.

A further object of the invention is to provide a razor handle of the above type having a housing containing the functional elements which may be employed throughout a line of razors and combined with a plurality of handle design variations.

Yet another object of the invention is to provide a razor handle which is comfortable to grip and provides ease of blade changing.

SUMMARY OF THE INVENTION

The above objects, and other objectives, which will become apparent as the description proceeds are accomplished by providing a razor handle assembly having a substantially flat planar body member with a top shell member mounted on one surface thereof and a bottom shell member mounted on the opposite surface thereof, each of the shell members covering only a portion of the peripheral top and bottom surface of the body member. The top shell member and the bottom shell member each have a portion extending forwardly beyond the body member and are attached one to the other to form a substantially enclosed housing. An opening is formed in the forward end of the housing having a pair of bearing members disposed adjacent the opening, the bearing members being movable toward and away from each other and adapted to receive a razor blade assembly and permit pivotal movement of the razor blade assembly on the handle assembly. Means are disposed in the housing for moving the bearing members toward and away from each other.

The forward portions of the shells forming the housing are generally inclined downwardly to form an angle with the body member and a pair of openings are formed one at each side of the housing, each opening containing one of a pair of buttons which extend through the openings. Each of the buttons are movable inwardly into the housing to cause the bearing member moving means to move the bearing members toward each other to release a razor blade assembly retained on the bearing members. The buttons may be interconnected by a flexible connector disposed within the housing and at least one of the shell members comprises means cooperating with each of the buttons to guide the button in a direction parallel to movement of the bearing members.

The bearing members are generally formed on the forward end of a unitary blade attachment member which is part of the means for moving the bearing members toward and away from each other. The legs are interconnected by a flexible hinge portion of the blade attachment member and a pair of laterally facing opposed surfaces are disposed one on each leg of the blade attachment member for contacting a respective button. A V-shaped spring member is disposed between the legs of the blade attachment member adjacent the flexible hinge biasing the leg surfaces outwardly against the buttons. The blade attachment member and the button assembly are both manufactured of a resilient plastic material to meet the functional requirements required during manufacturing assembly, and use in the razor handle.

BRIEF DESCRIPTION OF THE DRAWING

The foregoing and other features of the invention will be more particularly described in connection with the preferred embodiment, and with reference to the accompanying drawing, wherein.

DESCRIPTION OF THE PREFERRED EMBODIMENT

Figure 1:
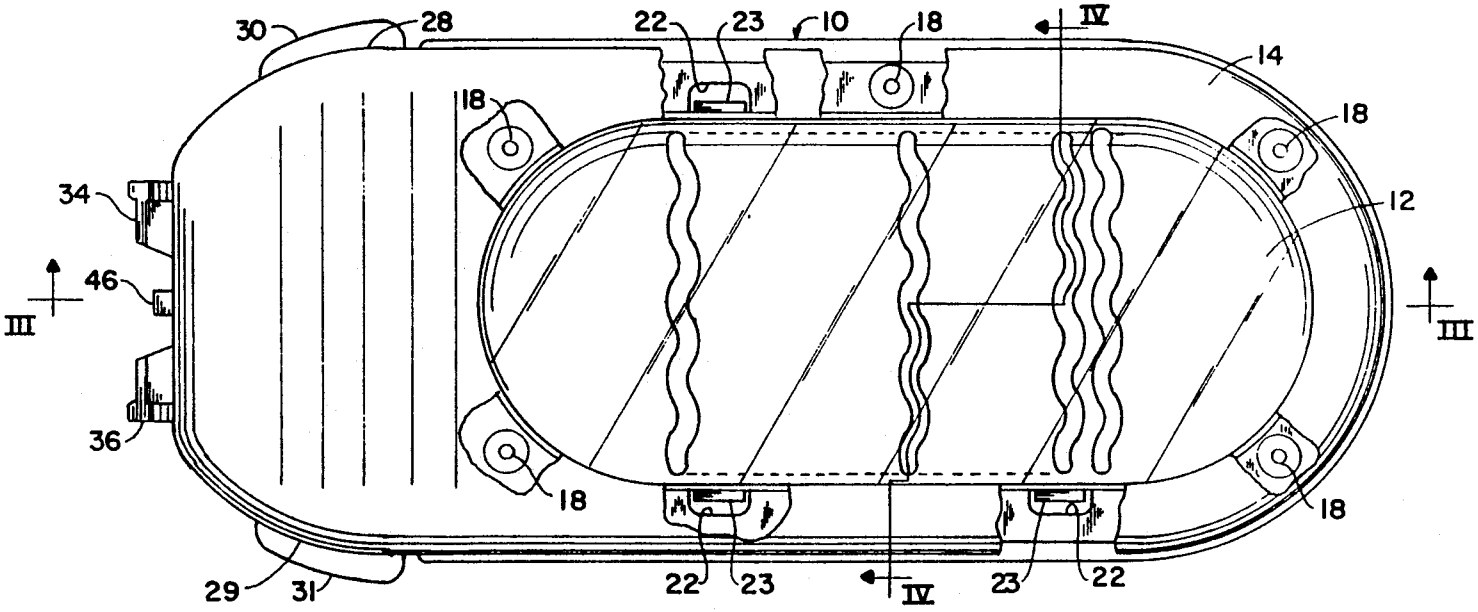
FIG. 1 is a top plan view, having portions broken away for clarity and showing a safety razor handle assembly constructed in accordance with the teachings of the present invention.

Referring now to the drawing, and in particular to FIGS. 1 through 4, there is shown a safety razor handle assembly 10 comprising a substantially flat planar body member 12 having a top shell member 14 and a bottom shell member 16 mounted on the opposite surfaces of the body member. The body member 12 is manufactured of a substantially rigid plastic material such as a styrene and may be of a color or design which is attractive to the user employing the razor handle assembly 10.

The top shell member 14 and bottom shell member 16 each are manufactured of a resilient plastic material such as ABS and as best shown in FIG. 1, the bottom shell member 16 is provided with a plurality of upwardly projecting cylindrical pins 18 which extend through an equal number of aligned circular openings 19 in the body member 12. With the body member 12 and the bottom shell member 16 assembled as shown in FIGS. 1 through 4, the upper portion of each of the pins 18 is formed to the configuration shown in FIG. 4, producing a head 20 and locking the two members together. As it will further be noted, the body member 12 is provided with a plurality of slots 22, each having an outwardly extending flange 23 disposed in alignment with the opening. The top shell member 14 is provided with a plurality of downwardly extending detents 24, as best shown in FIG. 4, in the same number as the slots 22 and aligned therewith such that when the top shell member 14 is placed onto the assembled body member 12 and bottom shell member 16, the detents 24 are snapped over the flanges 23 to secure the top shell member to the handle assembly 10.

With the top shell member 14, body member 12 and bottom shell member 16 thus assembled, it will be observed that the shell members 14 and 16 extend only about the periphery of the body member 12 and therefore enable the body member to be of a colored material or of a designed surface which may be changed from time to time, while retaining the top shell member and bottom shell member assembly employed in the present construction. With the members thus, the body member 12 extends slightly beyond the top shell member 14 and bottom shell member 16 to provide a firm and rigid sandwich structure for the grasp of the user.

Figure 2:
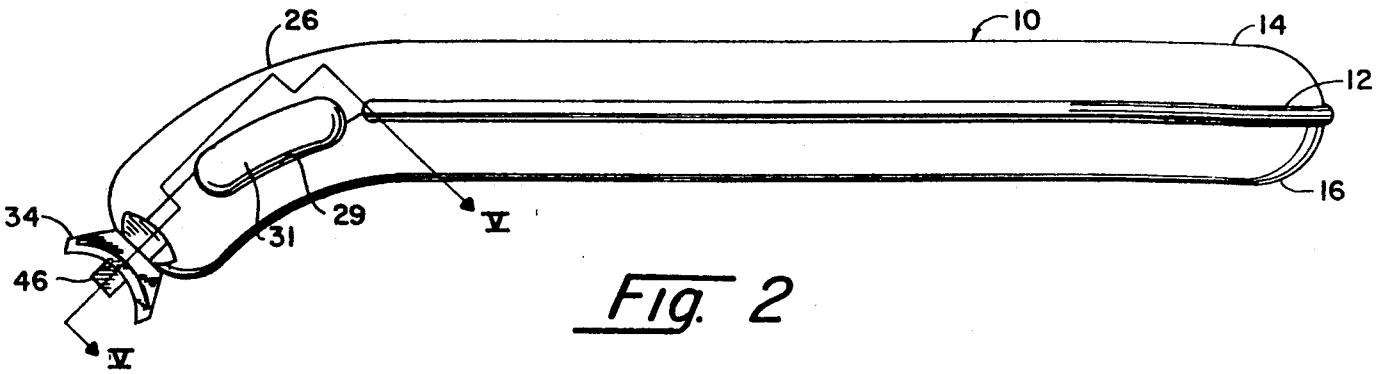
FIG. 2 is a left side elevational view showing the structure of FIG. 1.
Figure 3:
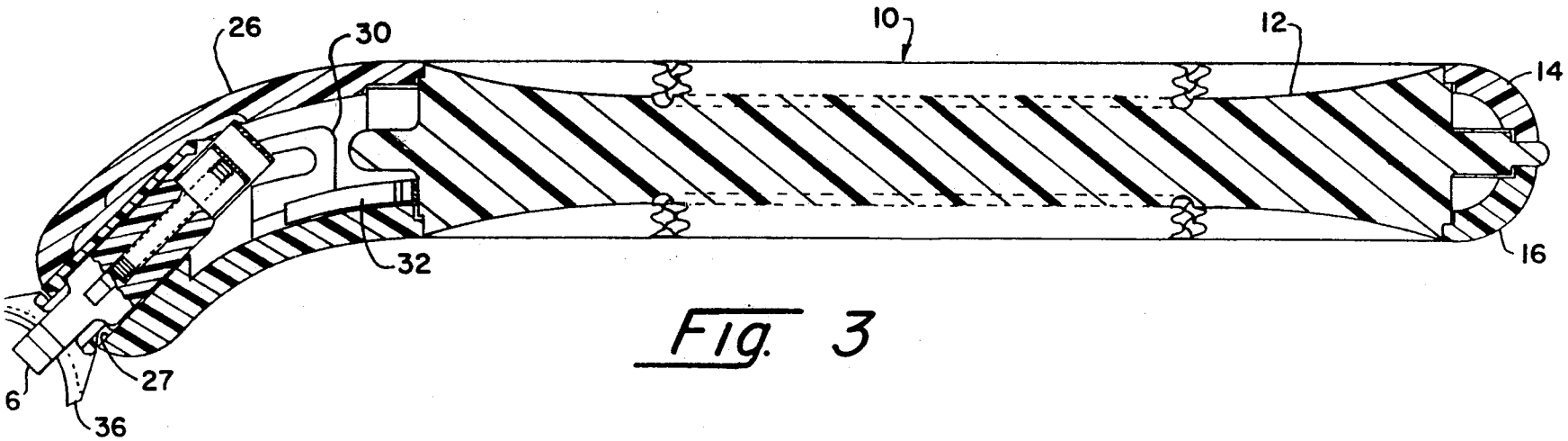
FIG. 3 is a left elevational sectional view taken along the lines III-III of FIG. 1 showing details of the structure of FIGS. 1 and 2.
Figure 4:
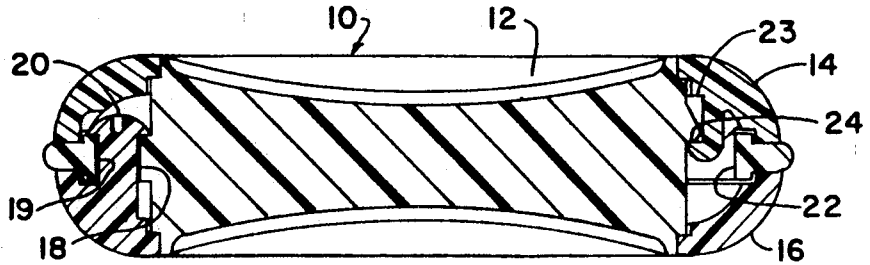
FIG. 4 is a rear elevational sectional view taken along the lines IV-IV of FIG. 1 showing further details of the structure of FIGS. 1 through 3.

Referring now to FIGS. 2 and 3, it will be noted that a portion of the top shell member 14 and bottom shell member 16 extend beyond the body member 12 and are curved downwardly at an angle of about 45° with the body member 12. That portion of the combined shell members 14 and 16 form a substantially enclosed housing 26 having a slotted opening 27 formed at the forward-most end of the shell members 14 and 16 and a pair of slotted openings 28 and 29 formed at the sides of the housing.

Figure 5:
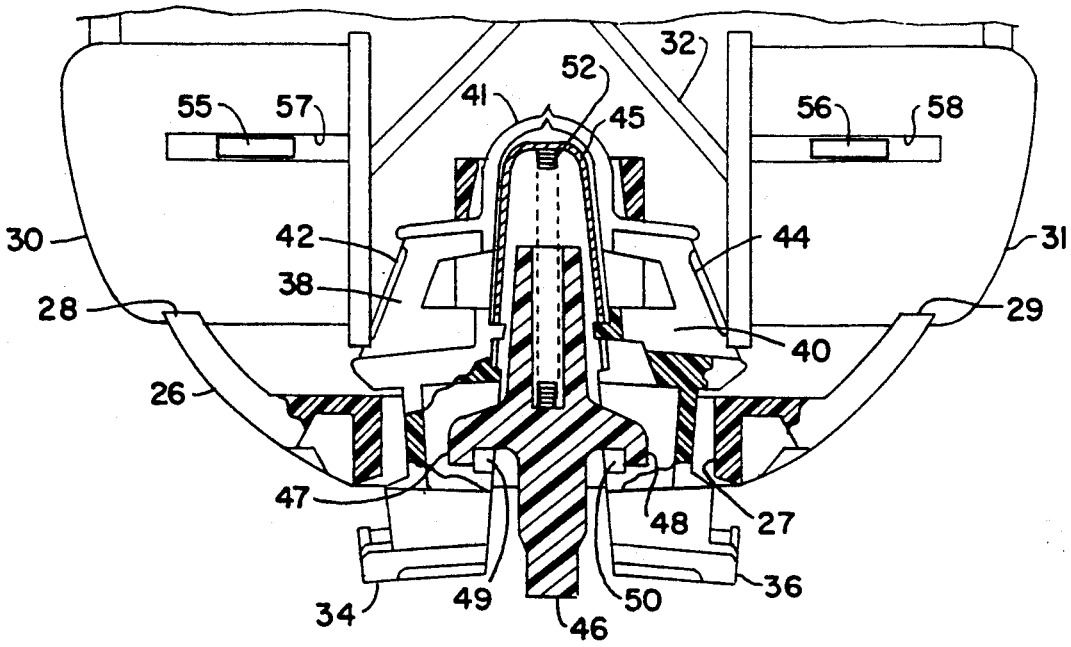
FIG. 5 is a top front sectional view taken along the lines V-V of FIG. 2 showing details of the operative mechanism of the safety razor handle assembly shown in FIGS. 1 through 4 during operation.
Figure 6:
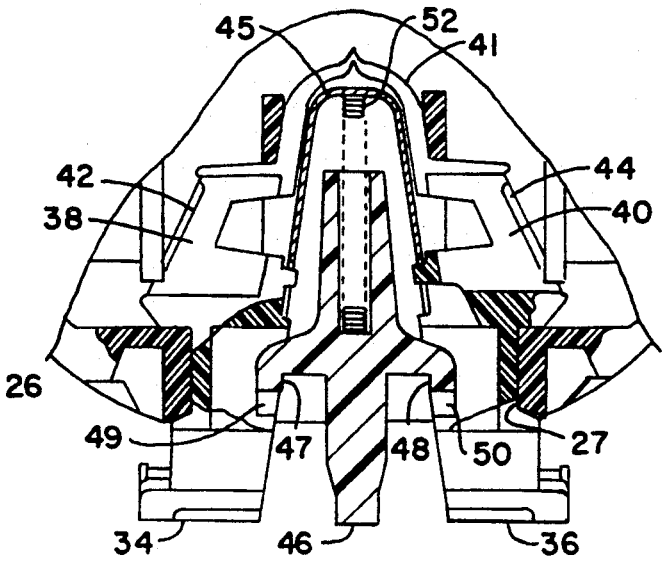
FIG. 6 is a top front sectional view similar to FIG. 5 showing details of the mechanism of FIG. 5 in the at rest position.

Referring now to FIGS. 5 and 6, taken in conjunction with FIGS. 1 through 4, a button assembly including a pair of buttons 30 and 31 are disposed within the housing 26 and are interconnected by a flexible web 32, the buttons 30 and 31 each extending through a respective slotted opening 28 and 29, as best seen in FIG. 5. The button is generally manufactured of Nylon or similar material suitable for employment in the operative mechanism to be described below.

A pair of bearing members 34 and 36 are disposed adjacent the slotted opening 27 and are movable toward and away from each other to accept a razor blade assembly for pivotal movement, as is well known in the art. The razor blade assembly for which the bearing members 34 and 36 are designed, as well as similar bearing members, are shown and described in U.S. Pat. No. 4,492,025 assigned to the assignee of the present invention which is herein incorporated by reference. Therefore, the bearing members and the related razor blade assembly will not be described in detail herein.

Referring back to FIGS. 5 and 6, the bearing members 34 and 36 are each formed on a pair of forwardly extending legs 38 and 40, respectively, which are interconnected by a flexible hinge 41 providing a unitary structure which is of one piece molded construction. A pair of laterally facing opposed surfaces 42 and 44 are disposed one on each of the legs 38 and 39 for contact with a respective button 30 or 31, and a V-shaped spring 45 is disposed between the legs 38 and 40 biasing the surfaces 42 and 44 against the buttons 30 and 31. Within the V-shaped spring 45 is located a plunger 46 having a pair of arms 47 and 48 which extend laterally and forwardly to contact a pair of detents 49 and 50 disposed on the legs 38 and 40. A helical spring 52 is received in a cylindrical opening in the base of the plunger 46 and extends rearwardly to contact the spring 45 and bias the plunger forwardly within the unitary assembly containing the legs 38 and 39.

In operation, the operative elements of the razor handle assembly 10 are in the configuration shown in FIG. 6 of the drawing when a blade assembly is not disposed on the razor handle, movement of the bearing members 34 and 36 toward one another being required for receiving a razor assembly for pivotal movement, as described in the aforementioned U.S. Pat. No. 4,492,025. The V-shaped spring 45 is biasing the buttons 30 and 31 outwardly and the helical spring 52 is biasing the plunger 46 forwardly, the forward surface of the arms 47 and 48 contacting the detents 49 and 50. In order to move the bearings members 34 and 36 inwardly to receive a razor assembly, the buttons 30 and 31 are pushed simultaneously inwardly and ride linearly inwardly guided by a pair of guide members 55 and 56 formed on the bottom shell 16, which are received in a pair of slots 57 and 58 formed in the buttons 30 and 31. With the legs 38 and 40 moved inwardly by virtue of movement of the buttons 30 and 31, the detents 49 and 50 are moved inwardly to a position which allows the arms 47 and 48 of the plunger 46 to assume the locked position shown in FIG. 5, the plunger 46 moving forwardly under the action of the spring 52. As described in the previously cited U.S. Pat. No. 4,492,025, when the blade assembly is placed over the bearing members, a portion of the blade assembly contacts the plunger 46 moving it inwardly to the released position, as shown in FIG. 6, in which the bearing members 34 and 36 are received in proper alignment in the blade assembly, the structural elements assuming the position as shown in FIG. 6 until the buttons 30 and 31 are again depressed to release the blade assembly.

From the foregoing, it will evident that the present invention provides a razor handle having a minimum number of elements to manufacture, as the buttons 30 and 31 are of unitary construction as well as the assembly comprising the bearings members 34 and 36. Further, by providing a pair of top and bottom shell members 14 and 16 in combination with the body member 12, a razor handle assembly is provided which is held in the fingers or the palm of the hand of the user, the body member comfortably providing rigidity to the handle assembly while enhancing the appearance of the assembly, as described above.

While it is apparent that modification and changes may be made within the spirit and scope of the present invention, it is our intention, however, only to be limited by the scope of the appended claims.

As our invention, we claim:

1. A razor handle assembly comprising:

a substantially flat planar body member to be held in the fingers or palm during use, a top shell member mounted on one surface thereof and a bottom shell member mounted on the opposite surface thereof, each of said shell members covering only the peripheral top and bottom surface of said body member;

said top shell member and said bottom shell member each having a portion extending forwardly beyond said body member and attached one to the other to form a substantially enclosed housing therebetween;

an opening formed int he forward end of said housing having a pair of bearing members disposed adjacent said opening, said bearing members being movable toward and away from each other and adapted to receive a razor blade assembly on said handle assembly; and means disposed in said housing for moving said bearing members toward and away from each other.

2. A razor handle assembly as set forth in claim 1 wherein said forwardly extending portions of said shells forming said housing extend downwardly forming an angle with said body member.

3. A razor handle assembly as set forth in claim 1 which further includes a pair of opening formed one on each side of said housing and a pair of buttons, a respective button extending each of said opening;

each said button being movably inwardly into said housing to cause said bearing member moving means to move said bearing members toward each other to release a razor blade assembly retained on said bearing members.

4. A razor handle assembly comprising wall structure forming a hand gripping portion at the rear end thereof and forming a substantially enclosed housing at the forward end thereof;

an opening formed in the forward end of said housing having a pair of bearing members disposed adjacent thereto, said bearing members being movable toward and away from each other and adapted to receive a razor blade assembly and permit pivotal movement of said razor blade assembly on said handle assembly;

a pair of openings formed on each side of said housing and a pair of buttons, a respective button extending through each of said openings;

said pair of buttons being formed of a unitary element comprising a flexible connector, each said button being interconnected by said flexible connector disposed within said housing; and means disposed in said housing for moving said bearing members toward and away from each other in response to movement of said buttons.

5. A razor handle assembly as set forth in claim 4 wherein said unitary element forming said buttons is comprised of a resilient plastic material.

6. A razor handle assembly as set forth in claim 4 wherein each said bearing member is formed on the forward end of a respective leg of a unitary blade attachment member, said legs being interconnected by a flexible hinge portion of said blade attachment member, and a pair of laterally facing opposed surfaces disposed one on each leg of said blade attachment member for contacting a respective button.

7. A razor handle assembly as set forth in claim 6 wherein said unitary blade attachment member is comprised of a resilient plastic material.

8. A razor handle assembly as set forth in claim 7 which further includes a V-shaped spring member disposed between the legs of said blade attachment member adjacent said flexible hinge for biasing said leg surface outwardly against said buttons.

9. A razor handle assembly comprising:

a substantially flat planar body member having a top shell member mounted on one surface thereof and a bottom shell member mounted on the opposite surface thereof, each of said shell members covering only the peripheral top and bottom surface of said body member;

said top shell member and said bottom shell member each having a portion extending forwardly beyond said body member and attached one to the other to form a substantially enclosed housing therebetween;

an opening formed in the forward end of said housing having a pair of bearing members disposed adjacent said opening, said bearing member being movable toward and away from each other and adapted to receive a razor blade assembly and permit pivotal movement of said razor blade assembly on said handle assembly;

means disposed in said housing for moving said bearing members toward and away from each other;

a pair of openings formed one on each side of said housing;

and a pair of buttons formed of a unitary element, a respective button extending through each of said openings;

each said button being interconnected by a flexible connector and disposed in said housing and being movable inwardly into said housing to cause said bearing member moving means to move said bearing members toward each other to release to razor blade assembly retained on said bearing members.

10. A razor handle assembly as set forth in claim 9 wherein said unitary element is comprised of a resilient plastic material.

11. A razor handle assembly as set forth in claim 9 wherein at least one of said shell members comprises means cooperating with each said button to guide said button in a direction parallel to the movement of said bearing members.

12. A razor handle assembly as set forth in claim 9 wherein each said bearing member is formed on the forward end of a respective leg of a unitary blade attachment member, said legs being interconnected by a flexible hinge portion of said blade attachment member, and a pair of laterally facing opposed surfaces disposed one on each leg of said blade attachment member for contacting a respective button.

13. A razor handle assembly as set forth in claim 12 wherein said unitary blade attachment member is comprised of a resilient plastic material.

14. A razor handle assembly as set forth in claim 12 which further includes a V-shaped spring member disposed between the legs of said blade attachment member adjacent said flexible hinge for biasing said leg surface outwardly against said buttons.

15. A razor handle assembly comprising a top shell member and a bottom shell member mounted in facing relation to form a hand gripping portion at the rear end thereof and forming a substantially enclosed housing at the forward end thereof, said forward end housing extending downwardly at an angle with said hand gripping portion of said assembly;

an opening formed in the forward end of said housing having a pair of bearing members disposed adjacent thereto, said bearing members being movable toward and away from each other and adapted to receive a razor blade assembly and permit pivotal movement of said razor blade assembly on said handle assembly;

a pair of openings formed on each side of said housing and a pair of buttons, a respective button extending through each of said openings;

said pair of buttons formed of a unitary element and being interconnected by a flexible connector disposed within said housing; and means disposed in said housing for moving said bearing members toward and away from each other in response to movement of said buttons.

16. A razor handle assembly as set forth in claim 15 wherein said unitary element forming said buttons is comprised of a resilient plastic material.

17. A razor handle assembly as set forth in claim 15 wherein at least one of said shell members comprises means cooperating with each said button to guide said button in a direction parallel to movement of said bearing members.

* * * * *